US005149414A

United States Patent [19]

Chiang et al.

[11] Patent Number: 5,149,414

[45] Date of Patent: Sep. 22, 1992

[54] OXYGEN GAS DIFFUSION ELECTRODE

[75] Inventors: John S. C. Chiang, Mercerville, N.J.; Charles J. Nicholson, New Hope, Pa.

[73] Assignee: FMC Corporation, Philadelphia, Pa.

[21] Appl. No.: 932,835

[22] Filed: Nov. 20, 1986

[51] Int. Cl.[5] ..... G25B 11/12

[52] U.S. Cl. ..... 204/294; 204/290 R; 264/105; 264/156

[58] Field of Search ..... 204/282, 283, 284, 294, 204/296; 264/105, 156

[56] References Cited

U.S. PATENT DOCUMENTS

| | | | |
|---|---|---|---|
| 3,459,652 | 8/1969 | Grangaard | 204/294 |
| 3,968,273 | 7/1976 | Kastening et al. | 427/122 |
| 4,118,305 | 10/1978 | Oloman et al. | 204/265 |
| 4,142,949 | 3/1979 | Faul et al. | 204/84 |
| 4,299,682 | 11/1981 | Oda et al. | 204/292 |
| 4,406,758 | 9/1983 | McIntyre et al. | 204/98 |
| 4,435,267 | 3/1984 | Batzold | 204/290 R |
| 4,457,953 | 7/1984 | McIntyre et al. | 427/113 |
| 4,481,303 | 11/1984 | McIntyre et al. | 204/98 |
| 4,581,116 | 4/1986 | Plowman et al. | 204/284 |
| 4,627,897 | 12/1986 | Tetaloff et al. | 204/128 |
| 4,697,359 | 3/1987 | Lindstrom | 204/294 |

OTHER PUBLICATIONS

Kordesch et al., (Maru, editor) "The Technology of PTFE-Bonded Carbon Electrodes", *Symposium on Porous Electrodes,* Electrochemical Soc. vol. 84-8, pp. 163-205, Pennington, N.J. (1984).

Yeager, E., Electrochemistry in Industry, Plenum Press, NY (1980) pp. 38-47.

Clark et al., "Carbon Fuel Electrodes", Proc. 18th Annual Power Sources Conf. May 19-21, 1960, pp. 11-14.

Rusinko, et al., "Fuel Cell Materials," Proc. 15th Annual Power Sources Conf. May 9-11, 1961, pp. 9-12.

Mitchell, W., *Fuel Cells,* Academic Press, NY (1963) pp. 158-159; 306-313; 344-347 and 406-413.

Gould (editor), *Advances in Chemistry,* Series 90, Fuel Cell Systems II, ACS, Wash. D.C., 1969, p. 15.

Gould (editor), *Advances in Chemistry,* Series 47, Fuel Cell Systems, ACS, Wash. D.C., 1965, pp. 10-11; 18-19; 106-107 and 112-113.

*Primary Examiner*—John Niebling
*Assistant Examiner*—Kathryn Gorgos
*Attorney, Agent, or Firm*—R. E. Elden; R. L. Andersen

[57] ABSTRACT

The invention is a porous gas diffusion electrode suitable for manufacturing hydrogen peroxide by the reduction of oxygen in an alkaline electrolyte and of a process for fabricating the electrode.

10 Claims, No Drawings

OXYGEN GAS DIFFUSION ELECTRODE

The present invention is a gas diffusion electrode suitable for reducing oxygen gas to hydrogen peroxide.

The suitability of many different carbon types for their use in oxygen or air cells as negative electrode was well established by the fuel cell battery studies.

Fuel cell electrodes used paraffin, polyethylene, polypropylene and other binding materials for providing the necessary hydrophobicity to the structures, creating a three-phase reaction zone where gas, electrolyte and conductive surface meet. Polytetrafluoroethylene (PTFE), available as aqueous suspension under the trade name "Teflon" was marketed in the later 1950's, and is useful for binding the particles together. However, it is well known that the performance of such hydrophobic electrodes can vary significantly depending on how they are prepared.

The fuel cell technology is useful as a general guide to the construction and operation of oxygen electrodes. However, there are several important distinctions between electrodes for fuel cells and electrodes to produce hydrogen peroxide by reducing oxygen in an alkaline electrolyte. One important difference is that fuel cell electrodes employ a catalyst to decompose hydrogen peroxide as it is formed. This decomposition provides part of the oxygen, decreasing oxygen needed to be supplied to the three phase reaction zone. Another significant distinction is that a fuel cell is intended to convert chemical compounds into electrical energy, while the present invention is a process to product hydrogen peroxide in an electrolytic cell.

According to Maru et al., "Proceedings of the Symposium on Porous Electrodes: Theory and Practice," Volume 84, 8, The Electrochemical Society, Pennington, N.J. (1984), the technological approach to optimizing a fuel cell is well known and each part should do the job it is designed for. In respect to an electrode structure it means that only a multi-layered, composite electrode can be successful. In sequence, beginning from the electrolyte side there are three principal layers to consider. First, a platinum catalyzed carbon layer is required which should not be too hydrophobic, otherwise it will not achieve a good interfacial contact with the electrolyte. The second layer, the diffusion layer, has the purpose of transporting the gas with a minimum of gas-pressure drop (absolute or partial pressure drop) to the wet catalyzed carbon layer. This part of the electrode must be highly liquid repellent, a barrier against the penetration tendency of the electrolyte. The third component is the current collector. In thin composite electrodes for alkaline cells it can be a porous nickel sheet impregnated with PTFE, or a nickel screen.

Rusinko et al., Fuel Cell Materials, *Proceedings 15th Annular Power Sources Conference* page 9 discloses that with regard to electrode pore size requirements, electrode pores greater than 1.0 μm in diameter are probably filled with electrolyte and, therefore, do not contribute to the cell reaction. In addition, the presence of a few large pores makes it impossible to operate an electrode without gas losses. The reference also discloses it has also been shown that gas flow operating characteristics can best be optimized with electrodes whose pores are completely homogeneous.

U.S. Pat. No. 4,118,305 to Oloman discloses that gas diffusion electrodes can provide sufficient electrode area to carry out reactions requiring low current densities such as the reduction of oxygen to form hydrogen peroxide. Other disadvantages of the gas diffusion electrodes are that they are susceptible to contamination, to deactivation by plugging and to deactivation by flooding of the pores with liquid.

Copending U.S. application Ser. No. 932,834 now U.S. Pat. No. 4,758,317, teaches a novel cell disposed in a generally horizontal attitude in which a porous gas diffusion cathode forms an upper surface of the cell. Both the anode compartment and the cathode compartment are preferably very narrow and may be filled with a porous, inert material such as a felt or fabric which serves to distribute the flow of the electrolyte uniformly across the surface of the anode and cathode.

The present invention is a method for fabricating a gas diffusion cathode for an electrolytic cell having a first cathode surface contacting electrolyte in the cell and the second cathode surface forming an upper surface of the cell wherein the improvement comprises perforating the cathode with a plurality of perforations, each perforation having a sufficient open area that the force of gravity on the electrolyte is greater than the capillary forces on the electrolyte.

Although the practice of this invention does not depend on any particular theory, it is convenient to explain the effect of the invention as a series of vents which prevent a localized nonuniform flow of electrolyte in the cell from resulting in channeling in the cell.

It is clear that the optimum size, shape and distribution of the perforations will depend on the specific variable operating conditions of the electrolytic cell. Variables may include the specific gravity of the electrolyte, the rate of flow of the electrolyte in the cell, the dimension of the cathode compartment, the surface tension and other physical and electrical conditions of the electrolytic cell. However, one skilled in the art can easily determine the optimum dimensions of a perforation for a particular cell without undue experimentation.

It is desirable for the size of the perforation to have the area equivalent to that of a circle about 0.2 mm in diameter or larger, for example 0.1 to 1 mm, distributed over the surface of the cathode every 1-2 cm. Although there is no upper limit to the area of a perforation, increasing the cumulative area of the perforations in the cathode reduces the total area of the electrode available for the electrolytic action.

The present invention is preferably employed when the cathode is a gas diffusion cathode employing as a base a flexible conductive material such as graphite fabric which is made hydrophobic by impregnating the flexible graphite fabric with about 40% to 70%, desirable about 45% to 65% of a polytetrafluoroethylene resin, applying a sufficient quantity of a first coating, containing about equal parts by weight of carbon black and polytetrafluoroethylene resin, and subsequently sintering the fabric in air at 360° to 370° C. to provide about 5 to 15 parts by weight of carbon black per 100 parts by weight of graphite fabric, and applying a sufficient quantity of a second coating of a slurry of quantity of a suspension of about 9 parts of carbon black to one part of a polytetrafluoroethylene resin by weight as a slurry in about 105 parts by weight water and about 15 parts by weight of a nonionic surfactant to add about 5% to 15% carbon black by weight to the graphite fabric after sintering, and sintering the fabric in air at about 360° C. to 370° C.

The graphite fabric may be felted graphite fibers, a fabric of woven graphite fibers or a fabric of knit graphite fibers. Supports may also be made of a metal base such as a nickel fabric impregnated with sintered nickel powder.

The best mode of practicing the present invention will become evident from the following, nonlimiting example.

EXAMPLE 1

A cathode was prepared of carbon black supported on a duPont Teflon 30B polytetrafluoroethylene (PTFE) impregnated graphite fabric (25 cm×15 cm×0.12 cm). The fabric which weighed 11.14 g was first cleaned to remove $H_2O_2$ decomposition catalysts by 4% NaOH, 10% nitric acid and thoroughly rinsed.

The graphite fabric was made hydrophobic or water repellent by impregnating with an aqueous suspension of duPont brand Teflon 30B PTFE to provide 7.1 g of PTFE of the graphite fabric. A first coating of equal parts by weight of carbon black and PTFE was applied to one surface and the coated graphite fabric was dried and sintered at 360° C. to 370° C. for about an hour. The increase in weight was 2.75 g.

A second coating was applied consisting of a suspension of 9 parts by weight carbon black to 1 part PTFE. The suspension was prepared by mixing 150 g water, 22 g Triton X-100 brand nonionic surfactant, 0.13 g of a 1M NaOH solution, 2.1 g Teflon 30B PTFE, and 12.8 g carbon black (Vulcan XC-72R). The mixture was applied to the cloth with a brush. The resulting cloth was then dried and sintered at 360° C. to 370° C. for one hour in air. The amount of carbon black added on the cloth in the layer was calculated to be about 3.4 mg/cm$^2$. The increase in weight was 1.48 g.

A cell was assembled employing a nickel plate anode 27 cm×19 cm as a base, and in successive layers, a 38 cm×16 cm×0.1 mm polyester felt, an acrylic/polyester membrane 25 cm×15 cm×0.1 mm having an average pore size of 0.45 micrometer with 0.75 mm slits punctured therein every centimeter. A second polyester felt 38 cm×15 cm×1.1 mm was placed on the membrane and then the cathode. A nickel screen contacted the upper surface of the cathode as a current collector. The two polyester felts overhung the two ends of the anode with the one end immersed in a 3.6% NaOH solution and acted as an electrolyte inlet for the cell. The cell was inclined downward from the electrolyte inlet at an angle of 12° and the solution was drawn through the cell by the wicking effect of the polyester felts. The cell was operated at a current density of 0.025 A/cm$^2$ and air scrubbed with 4% NaOH was blown over the cathode. After two 5 hours runs, the cathode was perforated with 0.5 mm vent holes 1 cm apart and electrolysis was continued for two additional 5 hour runs. The results are presented as Table I. It is clear that the cell performance increased substantially with the vent holes of inventive Runs 3 and 4.

TABLE I

| Run No. | Vent Holes | % Effic. | $H_2O_2$, % | Flow g/Min. |
|---|---|---|---|---|
| 1 | No | 85.0 | 0.85 | 10.3 |
| 2 | No | 84.7 | 0.85 | 10.2 |
| 3 | Yes | 95.0 | 0.98 | 9.9 |
| 4 | Yes | 97.0 | 0.88 | 11.3 |

What is claimed is:

1. A method for fabricating a flexible graphite fabric gas diffusion cathode for an electrolytic cell having a first hydrophobic cathode surface contacting electrolyte in the cell and a second cathode surface forming an upper surface of the cell wherein the improvement comprises perforating the flexible cathode with a plurality of perforations to provide a series of vents through the flexible cathode, each perforation having sufficient open area that the force of gravity on the electrolyte is greater than the capillary forces of the perforation on the electrolyte, thereby preventing a localized nonuniform flow of electrolyte in the cell.

2. The method of claim 1 wherein the cathode is perforated about every centimeter with perforations having a free area of a circle having a diameter of 0.1 to 1 mm.

3. The method of claim 1 wherein the cathode is a gas diffusion cathode having as a base a graphite fabric selected from the group consisting of felted graphite fibers, woven graphite fibers and knit graphite fibers.

4. The method of claim 3 wherein the cathode is perforated about every centimeter with perforations having a free area of a circle having a diameter of 0.1 to 1 mm.

5. The method of claim 1 wherein the cathode is prepared by a. impregnating a flexible graphite fabric with sufficient polytetrafluoroethylene resin to make the graphite fabric hydrophobic by providing 40% to 70% by weight of the resin on the graphite fabric, b. coating the impregnated graphite fabric with an aqueous slurry of about equal parts of carbon black and polytetrafluoroethylene and sintering the coated impregnated fabric, the carbon black being applied in an amount sufficient to provide about 5 to 15 parts by weight of carbon black per 100 parts of graphite fabric originally employed, and applying a sufficient quantity of a second coating of a suspension of about 9 parts of carbon black to one part of a polytetrafluoroethylene resin by weight as a slurry in about 105 parts by weight water and about 15 parts by weight of a nonionic surfactant to provide about 5% to 15% carbon by weight on the graphite fabric after sintering, c. sintering the fabric in air at about 360° to 370° C., and d. perforating the graphite fabric to provide a series of vents through the cathode.

6. A gas diffusion electrode made by the process of claim 5.

7. An improved flexible graphite fabric gas diffusion cathode for an electrolytic cell having a first hydrophobic cathode surface contacting electrolyte in the cell and a second cathode surface forming an upper surface of the cell wherein the improvement comprises perforating the flexible cathode with a plurality of perforations to provide a series of vents, each perforation having sufficient open area that the force of gravity on the electrolyte is greater than the capillary forces of the perforation on the electrolyte, thereby preventing a localized nonuniform flow of electrolyte in the cell.

8. The gas diffusion cathode of claim 7 wherein the cathode is perforated about every square centimeter with perforations having a free area of a circle having a diameter of 0.1 to 1 mm.

9. The gas diffusion cathode of claim 7 wherein the cathode is a gas diffusion cathode having as a base a graphite fabric selected from the group consisting of felted graphite fibers, woven graphite fibers and knit graphite fibers.

10. The gas diffusion cathode of claim 9 wherein the cathode is perforated about every square centimeter with perforations having a free area of a circle having a diameter of 0.1 to 1 mm.

* * * * *